United States Patent [19]

Flemons

[11] 4,149,213

[45] Apr. 10, 1979

[54] TWO WIRE MULTIPLE SWITCHING SYSTEM

[75] Inventor: Ralph S. Flemons, Peterborough, Canada

[73] Assignee: Canadian General Electric Company Limited, Toronto, Canada

[21] Appl. No.: 802,354

[22] Filed: Jun. 2, 1977

[30] Foreign Application Priority Data

Jun. 16, 1976 [CA] Canada ..... 254925

[51] Int. Cl.[2] ..... H01H 47/22

[52] U.S. Cl. ..... 361/191; 335/152

[58] Field of Search ..... 361/191, 192; 340/166 S; 335/152

[56] References Cited

U.S. PATENT DOCUMENTS 3,902,101 8/1975 Angner et al. ..... 361/192

FOREIGN PATENT DOCUMENTS 717183 8/1965 Canada.
757169 4/1967 Canada.
807284 2/1969 Canada.

*Primary Examiner*—Harry E. Moose, Jr.
*Attorney, Agent, or Firm*—R. A. Eckersley

[57] ABSTRACT

A two wire switching system is intended for use in a hostile environment such as a nuclear reactor where temperatures are in excess of 250° or 300° C. and where the use of a switch with a permanent magnet component or a component intended to have remanence is not desirable. The system uses eight reed switches each having three similar windings. No magnetized components are used. The switches are normally closed in the absence of a magnetic field and are opened when a net magnetic field results from current flowing through at least one winding. A pair of conductors interconnects the windings so that each conductor connects certain windings in a series arrangement to ground, giving a unique interconnection for each switch. A control current may be caused to flow in either conductor arrangement at a value of zero or plus or minus A or 2A amperes where A amperes is at least sufficient to cause actuation of a switch when it flows through one winding. It is not essential that the value of A amperes be constant so long as the ratio of plus or minus A:A or A:2A is constant. The switching system is suitable for connecting a selected one of eight temperature sensors across another pair of conductors to provide a temperature reading from the selected temperature sensor.

6 Claims, 2 Drawing Figures

TWO WIRE MULTIPLE SWITCHING SYSTEM

Figure 2:
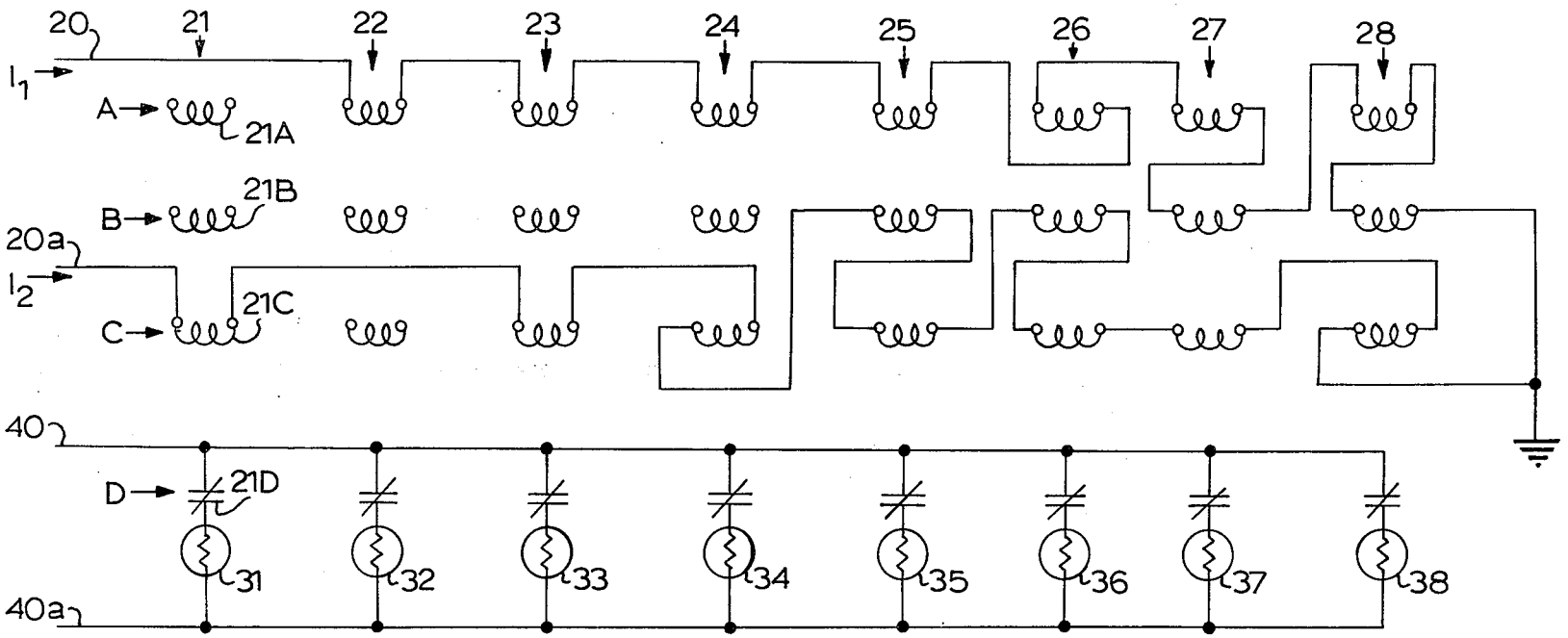

This invention relates to a two wire switching system, and in particular it relates to a two wire multiple switching system using reed switches and intended for use in a high temperature environment.

Reed type switches which are responsive to a mangetic field to open or close are well known. The magnetic field can be created by the flow of current through an adjacent coil or winding or by a combination of the flow of current through a winding and a permanent magnet. The use of a permanent magnet or of a magnetic control member which is magnetized by current flowing through an adjacent winding and which remains in the magnetized state, are known in a number of prior reed switches. The permanently magnetized member tends to keep the switch in one of its stable states after an actuating current is removed.

It is also known to achieve multiple switching over two wires with a ground return by using a plurality of reed switchs. One such prior art service uses two pair of reeds in a single enclosure with two adjacent windings and a permanent magnet to provide a bias. This switch can have one of four conditions in response to different currents over a single conductor and ground return. The switching is, however, dependent upon the field provided by the permanent magnet. Any change in the field of the permanent magnet changes the levels of current required for switching.

The reed switches of the prior art known to the inventor which provide multiple switching by control over a pair of conductors all appear to employ either a permanent magnet or a magnetic material having a high remenance characteristic. A switching system that is used in a hostile environment, for example with temperatures in excess of 300° C. or even with temperatures in excess of 250° C., should not rely on fields provided by a magnetic material. Permanent magnets or other magnetized material that must retain its magnetism at least temporarily can lose their magnetism or at least lose some strength with extended use in a high temperature environment.

In the operation of nuclear reactors it is frequently desirable to determine the temperature at a number of points in the high temperature region in the reactor. It is not desirable to have many conductors entering the high temperature region and the use of a two conductor multiple switching system is a suitable way of switching between a number of temperature detectors with a minimum of control conductors. It is, of course, very desirable that the switches operate for an extended period of time in the high temperature region without any malfunction and without any need for changing the value of the control currents. Consequently while a multiple switching system is desirable, it should not use switches with permanent mangets or magnetic elements which must retain magnetization.

It is therefore a feature of the invention to provide a multiple switching system of simple design using reed relays, and suitable for use in a high temperature environment.

The switching system of this invention uses reed switches with similar windings. In a preferred form the reed switch has three similar windings. The switch is normally closed when the magnetic field at the reeds is zero or is negligible for switching purposes. The switch opens when there is a magnetic field at the reeds induced by current flowing through one or more of the windings. The current for the windings is carried by two conductors with a ground return. Eight reed switches can be controlled by currents in the two conductors. For example, one conductor could have zero current and the other conductor any current in a suitable range of currents (it is important that the current need not be a specific value as in some prior art arrangement as long as it exceeds a minimum threshold value) and vice versa. That is, the currents in the conductors may be 1:0 and 0:1. When currents are flowing in both conductors the ratios of the currents in the two conductors may be 1:1, −1:1, 1:2, −1:2, 2:1 and −2:1. This gives eight ratios and distinctive controlling conditions. Note that where ratios of current are required, the currents need not be of any specific value as long as the ratios are correct. Alteration of circuit values will not affect proper operation of the system. No permanent magnets are used.

Accordingly in one form of the invention there is provided a control system for use in a hostile environment where the use of permanently magnetized material is not desirable, comprising a plurality of switching means each having a respective winding means and having a normal and an actuated condition and being operable from the normal to the actuated condition solely by the presence of an electro-magnetic field from a respective winding means, at least a pair of control conductors interconnecting said winding means to provide a unique electromagnetic field at each switching means in response to different ratios of currents flowing in said conductors to provide a selective actuation of said switching means, and control means connected to said control conductors to selectively provide desired ratios of current thereto.

In another form of the invention there is provided a two wire switching system for use in a hostile environment where the use of a permanently mangnetized material is not desirable, comprising eight reed switches each having a pair of contacts and each having three similar windings, said switches having a normal condition when there is negligible net magnetic field from current flowing in the windings and an actuated condition when there is a net magnetic field created by current flowing in at least one winding thereof, a pair of control conductors, each conductor connecting predetermined ones of said windings in a series arrangement to a point of common potential, said series arrangement of said windings providing a unique interconnection of windings for each switch, and control means connected to each of said control conductors to selectively provide thereto a current having a value selected from zero amperes and plus or minus A amperes and 2A amperes, where A amperes is suitable for creating an actuating magnetic field in a reed switch when flowing through a winding thereof, to selectively actuate all except one of said reed switches.

The invention will be described with reference to the drawings, in which

Figure 1:
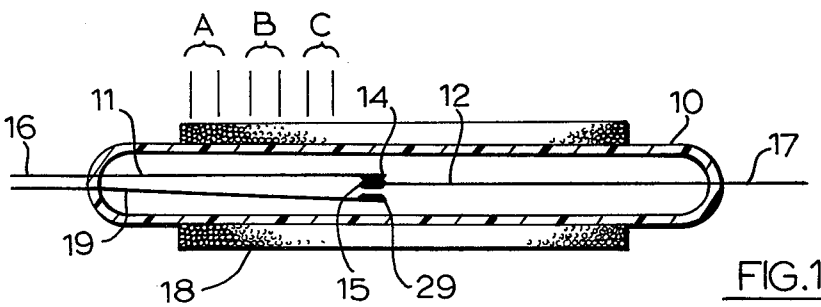
FIG. 1 (PRIOR ART)

FIG. 1 is a schematic drawing of a reed switch of a type known in the prior art and having three windings as required for the present invention, and FIG. 2 is a schematic wiring diagram showing circuitry according to the invention.

Referring to FIG. 1 there is shown a reed switch of a design suitable for use with the present invention. An envelope or enclosure 10 contains reeds 11, 12 and 19. Reeds 12 and 19 are of magnetically permeable material, while reed 11 is of a material that is not magnetically permeable. The reeds 11, 12 and 19 have at their respective inner ends contacts 14, 15 and 29. The outer ends of reeds 11 and 12 form switch terminals 16 and 17 extending externally of envelope 10. In the form of the invention described, no use is made of reed 9. Reed 12 is of a springy material and the spring force normally presses it towards reed 11 so that contacts 14 and 15 are in engagement with one another. When an axially directed magnetic field is present the magnetically permeable reeds 12 and 19 are attracted to one another and this attractive force overcomes the spring force from the material of reed 12 and causes contact 15 to be moved away from contact 14 and into engagement with contact 29. Thus the reed switch comprising reeds 11 and 12 is a "normally closed" switch which opens in the presence of a suitable axial magnetic flux. Three similar windings, each designed to have a substantially equal magnetic effect on the reeds, are indicated generally at 18. The windings may be referred to as A, B and C and the winding ends are indicated schematically. A design of reed switch having no reed 19 could be used.

Referring now to FIG. 2, control conductors 20 and **20*a* are shown. These conductors 20 and 20*a* carry the switching currents $I_1$ and $I_2$ respectively. There are eight reed switches numbered 21–28 and each has three windings A, B and C. That is, the first winding of reed switch 21 is designated 21A, the second winding 21B and so on. The switch element for each reed switch 21–28 is indicated at D. The switch elements 21D–28D are all normally closed and are opened in response to a net field created by current flowing in one or more of the windings on the respective switch. Each switch element 21D–28D is connected in series with a temperature detector or temperature sensor 31–38 respectively. The temperature sensor may be a thermistor as shown, or a thermocouple or any other suitable temperature responsive device. Each series combination of a switch element and a temperature sensor is connected across a pair of temperature signal carrying conductors 40 and 40*a*. It will be seen that a selective closing of one of the switches 21D through 28D will place a respective temperature detector 31 through 38 across the conductors 40 and 40*a*** and the current flow through the conductors, detected remotely, will indicate the temperature at the respective temperature detector.

The manner in which the windings of each reed switch 21–28 are connected is shown in FIG. 2. Following conductor 20 it will be seen that the windings 22A, 23A, 24A and 25A are connected in a normal or positive series arrangement, then winding 26A is connected in series in a reverse or negative manner, windings 27A and 27B are connected in a normal or positive series arrangement, then windings 28A and 28B are connected in a normal or positive series arrangement to a point of common potential such as ground. Following conductor **20*a*, it will be seen that windings 21C, 23C are connected in a normal or positive series arrangement, winding 24C is connected in a reverse or negative series arrangement, windings 25B, 25C, 26B, 26C and 27C are connected in a positive series arrangement, winding 28C** is connected in a reverse or negative series arrangement with a final connection to a point common potential or reference such as ground.

The table given below will indicate the operating conditions for the multiple switching arrangement. The current in either of the conductors 20 and **20*a* may be zero, A, −A, 2A or −2A amperes. It is important that specific values for the currents are not necessary. The values must, of course be in a suitable operating range but the actual values may fluctate as long as the ratios of currents remain the same. In the following table I, the switches are normally closed (indicated by "C") and remain closed as long as the net magnetic field caused by currents in conductors 20 and 20*a*** are zero or negligible. The presence of a magnetic field will open the switches (indicated by "0").

TABLE I

| CURRENT | SWITCHES 21D | 22D | 23D | 24D | 25D | 26D | 27D | 28D |
|---|---|---|---|---|---|---|---|---|
| $I_1$ = A, $I_2$ = 0 | C | 0 | 0 | 0 | 0 | 0 | 0 | 0 |
| $I_1$ = 0, $I_2$ = A | 0 | C | 0 | 0 | 0 | 0 | 0 | 0 |
| $I_1$ = −A, $I_2$ = A | 0 | 0 | C | 0 | 0 | 0 | 0 | 0 |
| $I_1$ = A, $I_2$ = A | 0 | 0 | 0 | C | 0 | 0 | 0 | 0 |
| $I_1$ = 2A, $I_2$ = A | 0 | 0 | 0 | 0 | C | 0 | 0 | 0 |
| $I_1$ = 2A, $I_2$ = A | 0 | 0 | 0 | 0 | 0 | C | 0 | 0 |
| $I_1$ = A, $I_2$ = −2A | 0 | 0 | 0 | 0 | 0 | 0 | C | 0 |
| $I_1$ = A, $I_2$ = 2A | 0 | 0 | 0 | 0 | 0 | 0 | 0 | C |

It is believed the operation of the switching system will be clear. For example, if a temperature reading is desired from temperature detector 36, it will be obtained when switch 26D is closed. From the table it will be seen that switch 26D is closed when a current $I_1$=2A is flowing in conductor 20 and a current $I_2$=A is flowing in conductor **20*a*. Winding 26A will then have a current of 2A amperes flowing through it in a reverse direction giving a magnetic field in one direction, and windings 26B and 26C will each have a current of A amperes flowing through them in a normal direction giving an equal magnetic field in the direction opposite to that caused by winding 26A. Thus the magnetic fields will cancel giving a net field of zero which will result in switch 26D** being in its normally closed position.

It will be apparent to those skilled in the art that by the provision of a fourth identical coil on each reed switch and the use of only two conductors, twelve reed switches could be connected in combinations which would allow the unique selection of one of the twelve switches. Similarly the provision of a fifth identical coil per switch and two conductors wuld enable selection of one of twenty switches. Table II, which follows, illustrates these relationships and also those for the case of two and three identical coils per switch, connected to two conductors, carrying currents in the ratios indicated.

TABLE II

| Number of Identical Coils | Ratios of Currents which can Produce Zero Flux in One Switch | | Number of Uniquely Selectable Switches |
|---|---|---|---|
| 2 | | 1:0, 0:1, 1:1 −1:1 | 4 |
| 3 | As for 2 coils plus | 2:1, 1:2 −2:1, −1:2 | 8 |
| 4 | As for 3 coils plus | 1:3, 3:1 −1:3, −3:1 | 12 |
| 5 | As for 4 coils plus | 1:4, 4:1, 2:3, 3:2 −1:4, −4:1, −2:3, −3:2 | 20 |

In the foregoing the assumption has been made that all switches are provided with similar windings having two or more identical coils per switch and that the desired magnetic effect for each switch is achieved by suitable interconnection of these coils. It will be apparent to those skilled in the art that the same turns-ratios achieved by various interconnection of three or more similar windings could be achieved by winding only two coils per switch having the required turns-ratios. By this means, also, non-integral turns-ratios could be achieved which might prove advantageous if many uniquely selectable switches were desired. The use of N identical coils, preferably wound simultaneously using N conductors, is the preferred embodiment, since precise algebraic addition and subtraction of flux from the several coils is thus assured.

The number of turns-ratios (or coils per switch in the preferred embodiment) could in theory be increased without limit to provide an infinite number of switching combinations. However problems of coil size, dissipation and current limits place a practical limitation on the number of switches which can be controlled over two wires.

It will also be apparent to those skilled in the art that the principle of this invention could be extended by the provision of more than two conductors which would allow the unique selection of more switches without the use of additional turns ratios. The two conductor case is, however, believed to be the most practical to implement.

It is believed that the preceding description is sufficient to provide a complete understanding of the invention, its uses and advantages.

What I claim as new and desire to secure by Letters Patent of the United States is:

1. A control system for use in a hostile environment where the use of permanently magnetized material is not desirable, comprising a plurality of switching means each having a respective winding means and having a normal and an actuated condition and being operable from the normal to the actuated condition solely by the presence of an electromagnetic field from a respective winding means, at least a pair of control conductors interconnecting said winding means to provide a unique electromagnetic field at each switching means in response to different ratios of currents flowing in said conductors to provide selective actuation of said switching means, and control means connected to said control conductors to selectively provide desired ratios of currents thereto.

2. A control system as defined in claim 1 in which there is one pair of control conductors, in which the plurality of switches are a number of switches selected from the groups comprising 4, 8, 12 and 20 switches, in which the winding means comprises a plurality of winding on each switch, the number of windings on each switch being related to the number of switches and being respectively 2, 3, 4 and 5 windings, and in which said control means provides a number of ratios of currents related to the number of switches and being respectively 4, 8, 12 and 20 ratios, for placing only one of said switches in an actuated condition.

3. A two wire switching system for use in a hostile environment where the use of permanently magnetized material is not desirable, comprising eight reed switches each having a pair of contacts and each having three similar windings, said switches having a normal condition when there is negligible net magnetic field from current flowing in the windings and an actuated condition when there is a net magnetic field created by current flowing in at least one winding thereof, a pair of control conductors, each conductor connecting predetermined ones of said wndings in a series arrangement to a point of common potential, said series arrangement of said windings providing a unique interconnection of windings for each switch, and control means connected to each of said control conductors to selectively provide thereto a current having a value selected from zero amperes and plus or minus A amperes and 2A amperes, where A amperes is suitable for creating an actuating magnetic field in a reed switch when flowing through a winding thereof, to selectively actuate all except one of said reed switches.

4. A two wire switching system for use in a hostile environment where the use of permanently magnetized material is not desirable, comprising eight reed switches each having a pair of contacts and each having three similar windings, said switches each having a normally closed condition when there is negligible net magnetic field form current flowing in the windings and an actuated open condition when there is a net magnetic field created by current flowing in at least one winding thereof, a pair of control conductors, each conductor connecting predetermined ones of said windings in a series arrangement to a point of common potential, said series arrangement of said windings providing a unique interconnection of windings for each switch, and control means connected to each of said control conductors to selectively provide thereover a current having a value selected from the values comprising zero amperes and plus or minus A amperes and 2A amperes, where A amperes is suitable for creating an actuating magnetic field in a reed switch when flowing in either direction through a winding thereof, to selectively actuate all except one of said reed switches.

5. A two wire switching system for use in a hostile environment where the use of permanently magnetized material is not desirable, comprising eight reed switches each having a pair of contacts and having first, second and third similar windings, said switches each having a normally closed condition of said contacts when there is neglibible net magnetic field from current flowing in the windings thereof and an actuated open conduit of said contacts when there is a net magnetic field created by current flowing in at least one of the windings thereof, first and second control conductors, said first conductors connecting in series arrangement for current flow through the windings in a first direction the first winding of the second, third, fourth and fifth reed switches, for current flow through the winding in a second direction opposite said first direction the first winding of the sixth reed switch, for current flow in said first direction the first and second windings of the seventh reed switch and the first and second windings of said eight reed switch, to a point of reference potential, said second conductor connecting in series arrangement for current flowing through the windings in said first direction the third winding of said first and third reed switches, for current flow through the winding in said second direction the third winding of the fourth reed switch, for current flow through the winding in said first direction the second and third windings of the fifth reed switch, the second and third windings of the sixth reed switch, the third winding of the seventh reed switch, and for current flow through the winding in said second direction the third winding of the right reed switch to a point of reference potential, and control means connected to each said first and second control conductors to selectively provide thereover a current having a value selected from the values comprising zero amperes and plus or minus A and 2A amperes, where A amperes is sufficient for creating an actuating magnetic field in reed switch when a current of A amperes flows in either direction through a winding of a respective reed switch, to selectively operate one of said reed switches.

6. A two wire switching system as defined in claim 5 and further comprising eight temperature sensors, a pair of temperature signal carrying conductors, each temperature sensor being connected in series with the contacts of a respective reed switch across said temperature signal carrying conductors whereby the closing of a switch will provide on said temperature signal carrying conductors a temperature indicating signal from a respective temperature sensor.

* * * * *